United States Patent [19]

Sujaku et al.

[11] Patent Number: 4,506,128

[45] Date of Patent: Mar. 19, 1985

[54] MICROWAVE OVEN HAVING SPECIALLY-POSITIONED ELECTRIC COMPONENTS

[75] Inventors: Takamichi Sujaku, Nagoya; Shuki Aoyama, Aichi; Takaaki Fukasawa, Nagoya, all of Japan

[73] Assignee: Tokyo Shibaura Denki Kabushiki Kaisha, Kawasaka, Japan

[21] Appl. No.: 542,448

[22] Filed: Oct. 17, 1983

[30] Foreign Application Priority Data

Oct. 18, 1982 [JP] Japan ..... 57-182524

[51] Int. Cl.[3] ..... H05B 6/74

[52] U.S. Cl. ..... 219/10.55 F; 219/10.55 R; 219/10.55 B; 361/358; 361/390

[58] Field of Search ..... 219/10.55 R, 10.55 B, 219/10.55 E, 10.55 F, 402; 361/334, 358, 359, 360, 380–384, 390, 391, 422; D7/351, 348

[56] References Cited

U.S. PATENT DOCUMENTS

| | | | |
|---|---|---|---|
| D. 197,263 | 12/1963 | Joseph | D7/348 |
| D. 239,690 | 4/1976 | Kumpfer | D7/351 |
| D. 240,349 | 6/1976 | Waagen | D7/351 |
| D. 241,220 | 8/1976 | Binzer | D7/351 |

FOREIGN PATENT DOCUMENTS

| | | | |
|---|---|---|---|
| 54-136451 | 10/1979 | Japan | 219/10.55 B |

*Primary Examiner*—Philip H. Leung

*Attorney, Agent, or Firm*—Schwartz, Jeffery, Schwaab, Mack, Blumenthal & Koch

[57] ABSTRACT

A microwave oven having an oven cabinet is provided with a heating chamber formed in the cabinet such that microwave heating and ordinary electrically resistive heating can be carried out. An oven door is pivotably mounted on the front side of the heating chamber and an inclined control panel is disposed below the oven door such that the panel inclines downwardly and projects forwardly from the front side of the cabinet to define an encasing portion for at least a part of electric components of the microwave oven underneath the heating chamber.

2 Claims, 3 Drawing Figures

MICROWAVE OVEN HAVING SPECIALLY-POSITIONED ELECTRIC COMPONENTS

BACKGROUND OF THE INVENTION

This invention relates to a high-frequency electronic cooking device and more particularly to a microwave oven wherein the arrangement of a control panel and electric parts or elements connected with the control panel is substantially improved.

A conventional microwave oven generally comprises a box-shaped cabinet, a heating chamber provided in the box-shaped cabinet, an oven door provided on the front side of the heating chamber, and a control panel including a number of control switches and the like, provided on one lateral side of the heating chamber. Such a microwave oven has the drawback that it occupies a relatively wide horizontal space in a kitchen or the like in which effective utilization of a horizontal space is desired rather than that of a vertical space.

To eliminate this drawback of the conventional microwave oven, there has been proposed a microwave oven wherein the control panel is provided below the oven door. This type of microwave oven has a heating chamber provided in the box-shaped cabinet, an oven door pivotably provided on the front side of the heating chamber, a turntable for supporting foodstuff provided in the heating chamber, the turntable being rotated by an electric motor disposed below the heating chamber, and a control panel, as described above, now arranged below the oven door. The control panel extends vertically, and electric components including a printed circuit board connected with the switches and the like on the control panel are located at a portion of the cabinet below the heating chamber and on the rear side of the control panel.

With the construction of the newly-developed microwave oven, the lateral space occupied by the oven can be reduced in comparison with the aforementioned laterally elongated construction, without affecting its performance.

However, the electric components are inevitably provided within the cabinet of the microwave oven below the electric motor driving the turntable. Since most of the foodstuff placed on the turntable to be cooked contains a liquid substance, this substance tends to be spilled out of the turntable onto the bottom plate of the heat chamber, and then through a penetrating hole of a rotating shaft for the turntable to the electric motor while the foodstuff is heated in the heating chamber. Accordingly, the above-described arrangement having the printed circuit board and the like below the electric motor is not desirous because of the tendency of harm to the electrical insulation of the circuit board and the like caused by the liquid substance spilled out of the turntable. Furthermore, the temperature of the cabinet portion on the underside of the heating chamber ordinarily rises up to 70° C. or more due to heat transmitted from the heating chamber. Exposure to such a temperature tends to deteriorate the circuit board and other electric parts or elements.

SUMMARY OF THE INVENTION

An object of the present invention is to provide a microwave oven wherein the above-described difficulties of the conventional microwave ovens can be substantially overcome.

Another object of the invention is to provide a microwave oven wherein a control panel is inclined downwardly below an oven door and projects forwardly so that electric components connected with an indicator and control switches on the control panel can be protected from a liquid substance escaping or heat transmitted from a heating chamber.

These and other objects of the present invention can be achieved by a microwave oven which comprises an oven cabinet having a front wall, a rear wall, side walls, a top wall, and a bottom wall, the front wall including an access opening for a foodstuff to be cooked and the bottom wall including a plurality of ventilation holes, a heating chamber formed in the oven cabinet and supplied with microwave energy, an oven door pivotably mounted on the front wall of the oven cabinet, electric components disposed in the cabinet for electrically controlling operation of the microwave oven, and a control panel board disposed between the lower end of the front wall of the cabinet and the bottom wall thereof and for arranging an indicator and control switches connected to the electric components. The control panel board inclines downwardly and outwardly from the lower end of the front wall of the cabinet to the bottom wall thereof so that the control panel board and the cabinet define a space below the heating chamber for arranging and protecting at least a part of the electric components from spilled liquid substance and dissipate heat transmitted from the heating chamber.

DESCRIPTION OF THE PREFERRED EMBODIMENT

For better understanding of the present invention, a conventional microwave oven and difficulties accompanying use thereof will be described first, with reference to FIG. 1.

Figure 1:
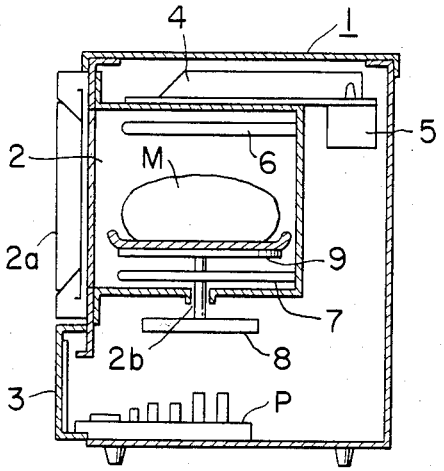
FIG. 1 PRIOR ART
FIG. 1 is a vertical cross-sectional view of a conventional microwave oven having a control panel below the oven door.

In the conventional microwave oven shown in FIG. 1, which has been recently developed and now in practical use, a heating chamber 2 and a control panel 3 are vertically arranged in a cabinet 1 of the microwave oven so that a vertically elongated construction is obtained. A waveguide 4 has a radiation opening at one end through an upper wall of the heating chamber 2 and the other end coupled with a microwave oscillator 5 such as a magnetron also provided in the cabinet 1. Electric heaters 6 and 7 of an ordinary type are provided at upper and lower portions in the heating chamber 2. A turntable 9 for supporting a foodstuff M is further disposed in the heating chamber 2 at a position slightly upward from the lower electric heater 7 and is rotated by an electric motor 8 located below the heating chamber 2. The heating chamber 2 has an access opening, and a door 2*a* is secured pivotably to one side of the opening. A control panel 3 is provided which extends downwardly from the door 2*a* in a vertical plane in substantial alignment with the surface of the door 2*a*.

Various switches and indicators are provided on the control panel 3. Electric components, such as a printed circuit board P and electric parts thereon, connected to switches and indicators on the control panel board 3 are arranged below the heating chamber 2 of the cabinet 1.

In the above-described conventional microwave oven, the printed circuit board P and the electric parts thereon are inevitably arranged in an area directly below the electric motor 8 having a driving shaft extending to the turntable 9 through a hole 2*b* formed through the bottom plate of the heating chamber 2. Since the foodstuff placed and cooked on the turntable 9 very often contains a large quantity of liquid substance, a part of the liquid substance spilled onto the bottom plate tends to leak through the hole 2*b* of the bottom plate downwardly to the electric motor 8, and then to the printed circuit board P and the electric parts thereon to deteriorate the same. Furthermore, since the electric components are placed substantially below the electric motor 8, they tend to be exposed to heat transmitted from the heating chamber and microwave energy escaping same, thus causing deterioration the electrical insulation and reducing the durability of the microwave oven.

Figure 2:
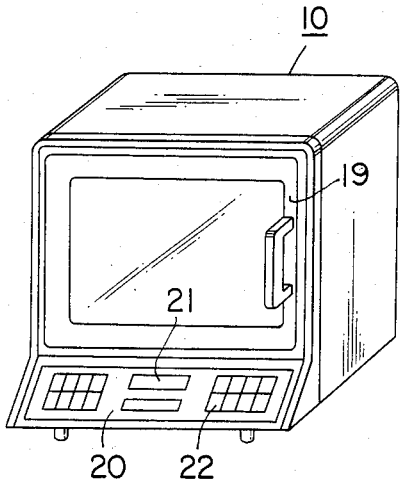
FIG. 2 is a perspective view of a microwave oven according to the present invention.
Figure 3:
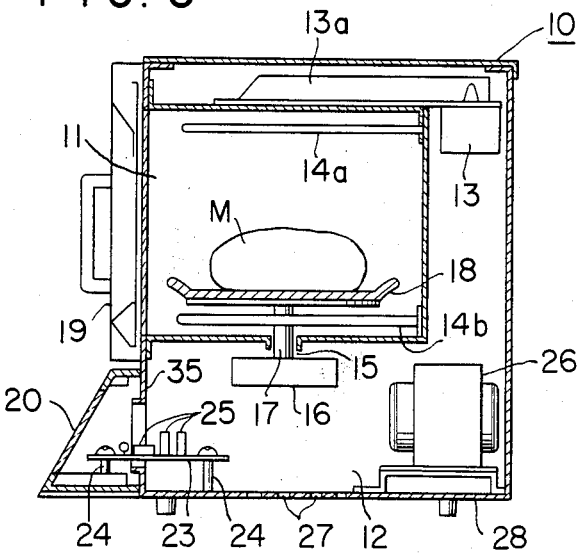
FIG. 3 is a vertical sectional view of the microwave oven shown in FIG. 2.

According to the present invention, the above-described difficulties of the conventional microwave ovens can be substantially eliminated. A preferred embodiment of the present invention will now be described with reference to FIGS. 2 and 3.

In a cabinet 10 of a microwave oven of this invention is provided a heating chamber 11 having an access opening on the front side. One end of a waveguide 13*a* opens to the heating chamber 11 through the upper wall of the heating chamber 11 and the other end of the waveguide 13*a* is coupled with a microwave oscillator such as a magnetron 13. A pair of electric heaters 14*a* and 14*b* are disposed in upper and lower portions of the heating chamber 11, respectively. In the bottom wall of the heating chamber 11 is provided a through hole 15, through which a driving shaft 17 of an electric motor 16 located in a chamber 12 defined underneath the bottom wall extends upwardly into the heating chamber 11. In the heating chamber 11, the driving shaft 17 is detachably coupled with the lower side of a turntable 18, on which a foodstuff M to be cooked is placed. An oven door 19 is pivotably mounted on the front wall of the cabinet 10 so as to horizontally open or close the opening of the heating chamber 2. On the front side of the cabinet 10 and below the oven door 19, is provided a control panel 20. The control panel 20 has an upper edge projecting forwardly from the cabinet by a distance equal to the thickness of the oven door 19 and a lower edge further projecting forwardly in excess of the upper edge so that the control panel is tapered forwardly downwardly. An indicator 21 and control switches 22 inclusive of a power switch, a cooking start switch and a timer switch are provided on the control panel 20. On the rear side of the control panel 20 are provided electric components such as a printed circuit board 23 and the like which are secured to the bottom plate of the chamber 12 by means of fixing members 24 in such a manner that most of the circuit board is received in tapered space defined by the control panel 20 and the lower portion of the cabinet 10. As a result, a comparatively large distance can be provided between the circuit board 23 and the position immediately below the electric motor 16. On the upper surface of the printed circuit board 23 are mounted various electric parts or elements 25 connected to the indicator 21 and the control switches 22 on the control panel 20. Although in FIG. 3, some part of the printed circuit board 23 and electric parts or elements 25 are arranged within the chamber 12, it may otherwise be so arranged that the printed circuit board 23 and the electrical parts or elements 25 are completely encased in the tapered space on the rear side of the control panel 20.

A high voltage transformer 26 and other electric devices such as condensers and a blower motor (not shown) are disposed in a rear part of the chamber 12 of the cabinet 10 and electrically connected with the printed circuit board 23, magnetron 12, and the electric heaters 14*a* and 14*b* as appropriate. A plurality of ventilation holes 27 are perforated through the bottom wall of the cabinet 10.

In the operation of the microwave oven of the present invention, a foodstuff M to be cooked is placed on the turntable 18, the oven door 19 is closed, and the control switches 22 are manipulated as desired for instructing the type of heating, heating time, heat intensity and the like. Thus, the turntable 18 is rotated, and either or both of the magnetron 12 and the electric heaters 14*a* and 14*b* are operated as instructed to cook the foodstuff M.

At this time, if liquid is spilled in the heating chamber 11, it tends to leak out of the heating chamber 11 through the hole 15 along the driving shaft 17 of the electric motor 16, into the chamber 12 underneath of the heating chamber 11. In this case, however, since the printed circuit board 23 together with the electric parts and elements, and also the transformer 26 and like devices are all arranged at positions spaced apart from the position directly below the electric motor 16, the liquid leaking into the chamber 12 on the underside of the heating chamber 11 is delivered outside through the ventilation holes 27 provided on the bottom wall of the chamber 12 without deteriorating the electric components.

Furthermore, if microwave energy leaks into the chamber 12 through the hole 15, it does not cause any harmful effect on the electric components.

When the temperature of the heating chamber 11 rises during operation of the magnetron 13 and/or the electric heaters 14*a* and 14*b*, it is difficult for hot air in the heating chamber 11 to come down to the chamber 12 because cool air is always supplied through the ventilation holes 27 of the bottom wall. Further, the control panel 20, in addition to the cabinet 10, functions as means for dissipating heat transmitted from the heating chamber 11. Therefore, the printed circuit board 23 and other electric parts or elements 25 are not exposed to a high temperature and no harmful effects result thereby.

According to the present invention, since a control panel 20 provided below the pivotable door 19 of the heating chamber 11 is inclined so that the lower edge thereof projects forwardly in excess of the upper edge, and at least a part of electrical components such as the printed circuit board 23 and the like are arranged in space formed on the rear side of the inclined control panel 20, electrical components can be protected from harmful effects of liquid substances produced by the foodstuff M and microwave energy escaping the heating chamber, and the durability and reliability of the microwave oven can be substantially improved. Furthermore, by the provision of the inclined control panel 20, the operability of the microwave oven can be much improved, and the space in the kitchen required for the microwave oven can be thereby more effectively utilized.

What is claimed is:

1. A microwave oven having specially positioned electric components comprising:

an oven cabinet having a front wall, a rear wall, side walls, a top wall, and a bottom wall, said front wall being shorter than said rear wall and including an access opening for a foodstuff to be cooked, and said bottom wall being longer than said top wall and including a plurality of ventilation holes;

a heating chamber formed in said oven cabinet;

a turntable disposed within said heating chamber and attached to a shaft extending through a bottom of said heating chamber;

an oven door pivotably mounted on the front wall of said oven cabinet;

a plurality of electric components located in the oven cabinet for electrically controlling operation of the microwave oven; and a control panel board disposed between a lower end of the front wall of said oven cabinet and the bottom wall thereof, said control panel including an indicator for displaying a cooking condition and control switches for setting operating conditions of the microwave oven, said indicator and said control switches being electrically connected to said plurality of electric components, said control panel board inclining downwardly and outwardly from the lower end of the front wall of the oven cabinet to the bottom wall thereof and defining with said bottom and side walls a space positioned below said heating chamber and toward the front of said cabinet containing at least part of said plurality of electric components so as to protect said at least part of said plurality of electric components contained in said space from liquids and to dissipate heat transmitted from said heating chamber.

2. A microwave oven as claimed in claim 1, wherein said space contains substantially all of said plurality of electric components.

* * * * *